US006528141B1

(12) United States Patent
Watson et al.

(10) Patent No.: US 6,528,141 B1
(45) **Date of Patent: *Mar. 4, 2003**

(54) SUPPORT STRUCTURE AND METHOD OF ASSEMBLING SAME

(75) Inventors: Stanley A. Watson, Franklin, MA (US); David G. Powell, Wellesley Hills, MA (US)

(73) Assignee: Diamond Machining Technology, Inc., Marlborough, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/374,339

(22) Filed: Aug. 13, 1999

Related U.S. Application Data

(63) Continuation-in-part of application No. 09/212,113, filed on Dec. 15, 1998, now Pat. No. 6,261,167.

(51) Int. Cl.[7] ..... B32B 3/10

(52) U.S. Cl. ..... 428/140; 428/131; 428/132; 428/133; 428/137; 428/138; 428/139; 156/292; 156/293

(58) Field of Search ..... 428/119, 125, 428/130, 131, 132, 133, 134, 135, 136, 137, 138, 139, 140; 408/93; 156/292, 293

(56) References Cited

U.S. PATENT DOCUMENTS

| | | | | |
|---|---|---|---|---|
| 2,156,717 | A | 5/1939 | Bendure | 51/186 |
| 2,175,073 | A | 10/1939 | Amstuz | 51/195 |
| 2,360,798 | A | 10/1944 | Seligman et al. | 51/309 |
| 2,906,612 | A | 9/1959 | Anthony et al. | 51/309 |
| 3,141,270 | A | 7/1964 | Ferrand | 51/205 |
| 3,287,862 | A | 11/1966 | Abernathy | 51/204 |
| 3,495,359 | A | 2/1970 | Smith et al. | 51/204 |
| 3,517,464 | A | 6/1970 | Mattia et al. | 51/309 |
| 3,785,938 | A | 1/1974 | Sam | 204/16 |

(List continued on next page.)

FOREIGN PATENT DOCUMENTS

| | | | |
|---|---|---|---|
| DE | 2037812 | 3/1972 | |
| DE | 3430473 A1 | 2/1986 | |
| DE | 3834205 A1 | 6/1989 | |
| DE | 3809767 A1 | 10/1989 | |
| EP | 0 238 434 A2 | 9/1987 | C23C/24/00 |
| EP | 05124060 | 5/1993 | |
| EP | 0606091 | 7/1994 | |
| GB | 1 229 980 | 4/1971 | B24D/17/00 |
| WO | WO 93/04818 | 3/1993 | B24D/3/06 |
| WO | WO 96/14963 | 5/1996 | B24D/5/12 |

OTHER PUBLICATIONS

Advanced Materials & Processes, "Ford Focus has hybrid plastic–metal front end" (Mar. 1999).

Diamond Machining Technology, Inc., Unique Diamond Sharpening Products For Industry (1996).

Miller, Paul C., "Cutting–tool coatings: Many strengths," Tooling & Production, Sep., 1991, pp. 34–37.

Charrier, Polymeric Materials and Processing, 453, 466, 507 (Hanser Pub. 1990).*

*Primary Examiner*—Paul Thibodeau
*Assistant Examiner*—Christopher Paulraj
(74) *Attorney, Agent, or Firm*—Kirkpatrick & Lockhart LLP

(57) ABSTRACT

A support structure includes a first sheet with perforations having a front surface and a back surface and a second sheet with perforation having a front surface and a back surface. Each perforation in the first sheet and the second sheet has a portion adjacent to the front surface of the sheet that is wider than a portion of the perforation that is adjacent to the back surface of the sheet. A core made of a first material is formed between the back surface of the first sheet and the back surface of the second sheet and within the perforations to anchor the first sheet and the second sheet to the core. Molded features may be disposed on the front surfaces of the sheets and integrally formed with the core through perforations in the sheets. The support structure may be used in a horizontal base or an end-of-arm tool.

25 Claims, 9 Drawing Sheets

U.S. PATENT DOCUMENTS

| | | | | | |
|---|---|---|---|---|---|
| 3,795,497 | A | | 3/1974 | Weiss | 51/297 |
| 3,835,598 | A | | 9/1974 | Tobey | 51/396 |
| 3,860,400 | A | | 1/1975 | Prowse et al. | 51/295 |
| 3,956,858 | A | | 5/1976 | Catlin et al. | 51/393 |
| 4,004,774 | A | * | 1/1977 | Houston | 249/114 |
| 4,047,902 | A | | 9/1977 | Wiand | 51/295 |
| 4,078,906 | A | | 3/1978 | Green | 51/295 |
| 4,079,552 | A | | 3/1978 | Fletcher | 51/295 |
| 4,106,962 | A | | 8/1978 | Adams et al. | 156/73.1 |
| 4,155,721 | A | | 5/1979 | Fletcher | 51/295 |
| 4,213,555 | A | * | 7/1980 | Minkiewicz et al. | 228/29 |
| 4,227,356 | A | * | 10/1980 | Stern et al. | 52/309.4 |
| 4,256,467 | A | | 3/1981 | Gorsuch | 51/295 |
| 4,381,227 | A | | 4/1983 | Narcus | 204/16 |
| 4,460,382 | A | | 7/1984 | Ohno | 51/307 |
| 4,560,853 | A | | 12/1985 | Ziegel | 219/121 LD |
| 4,601,150 | A | * | 7/1986 | Dougherty | 52/309.12 |
| 4,608,128 | A | | 8/1986 | Farmer et al. | 204/16 |
| 4,674,237 | A | | 6/1987 | Sullivan | 51/391 |
| 4,826,508 | A | | 5/1989 | Schwartz et al. | 51/293 |
| 4,874,478 | A | | 10/1989 | Ishak et la. | 204/16 |
| 4,945,686 | A | | 8/1990 | Wiand | 51/293 |
| 4,951,423 | A | | 8/1990 | Johnson | 51/168 |
| 5,022,895 | A | | 6/1991 | Wiand | 51/295 |
| 5,049,165 | A | | 9/1991 | Tselesin | 51/295 |
| 5,078,555 | A | * | 1/1992 | Aurentz | 408/231 |
| 5,109,637 | A | | 5/1992 | Calafut | 51/391 |
| 5,131,924 | A | | 7/1992 | Wiand | 51/293 |
| 5,133,782 | A | | 7/1992 | Wiand | 51/295 |
| 5,154,550 | A | | 10/1992 | Isobe et al. | 408/144 |
| 5,161,335 | A | | 11/1992 | Tank | 51/204 |
| 5,176,155 | A | | 1/1993 | Rudolph, Jr. | 132/76.4 |
| 5,203,881 | A | | 4/1993 | Wiand | 51/293 |
| 5,281,244 | A | | 1/1994 | Wiand | 51/295 |
| 5,317,839 | A | | 6/1994 | Anderson | 51/205 WG |
| 5,500,272 | A | | 3/1996 | Padden | 428/140 |
| 5,573,453 | A | | 11/1996 | Tiefenbach, Jr. | 451/533 |
| 5,919,084 | A | | 7/1999 | Powell et al. | 451/344 |
| 5,976,001 | A | | 11/1999 | Powell et al. | 451/540 |
| 6,261,167 | B1 | * | 7/2001 | Watson et al. | |
| 6,279,652 | B1 | * | 8/2001 | Chatterji et al. | 166/194 |

* cited by examiner

SUPPORT STRUCTURE AND METHOD OF ASSEMBLING SAME

BACKGROUND OF THE INVENTION

This is a continuation-in-part of Ser. No. 09/212,113, filed on Dec. 15, 1998 now Pat. No. 6,261,167.

This invention relates to a support structure, and in particular, a support structure with two sheets bonded to a core.

Support structures used in various industrial applications are designed to maximize rigidity and stiffness and to minimize weight of materials, production costs and difficulty of manufacture and assembly. Such a support structure may be, e.g., an abrasive tool used to sharpen, grind, hone, lap or debur a work piece or substrate of hard material, e.g., a knife. Such an abrasive tool may have a surface coated with abrasive grains such as diamond particles. An abrasive tool having an abrasive surface with depressions, e.g., an interrupted cut pattern, is known to be effective for chip clearing when applied to various work pieces. Abrasive tools must be rigid and durable for many commercial and industrial applications.

SUMMARY OF THE INVENTION

In general, in one aspect, in the invention features a first sheet with perforations having a front surface and a back surface and a second sheet with perforation having a front surface and a back surface. Each perforation in the first sheet and the second sheet has a portion adjacent to the front surface of the sheet that is wider than a portion of the perforation that is adjacent to the back surface of the sheet. A core made of a first material is formed between the back surface of the first sheet and the back surface of the second sheet and within the perforations to anchor the first sheet and the second sheet to the core.

Implementations of the invention may also include one or more of the following features. The core may be formed by injection molding, casting or laminating. The first material may include a plastic material, such as a glass filled polycarbonate composite, a resin, epoxy or a cementitious material.

The perforations may be bevelled or counterbored. The first sheet and the second sheet may have perforations in a portion less than the entirety of the sheets.

The support structure may further include a molded feature disposed on the front surface of the first sheet and integrally formed with the core, the molded feature being attached to the core through a perforation in the first sheet.

In general, in another aspect, the invention features a method of assembling a support structure. A first sheet having a front surface and a back surface and perforations therein is provided, with each perforation having a portion adjacent to the front surface of the sheet that is wider than a portion of the perforation that is adjacent to the back surface of the sheet. A second sheet having a front surface and a back surface and perforations therein is provided, each perforation having a portion adjacent to the front surface of the sheet that is wider than a portion of the perforation that is adjacent to the back surface of the sheet. The back surfaces of the first and second sheets are oriented spaced apart from and facing each other. A core is formed between the spaced apart back surfaces of the first and second sheets and in the perforations in the first and second sheets.

Implementations of the invention may also include one or more of the following features. The core may be formed by injecting a first material between the spaced apart back surfaces of the first and second sheets and the first material is hardened. The first material injected between the spaced apart back surfaces of the first and second sheets may flow into the perforations in the first and second sheets. The core may also be formed by casting or laminating.

The orienting step may include placing the first and second sheets into a mold. The method may further include grinding the front surfaces of the first and second sheets.

In general, in another aspect, the invention features a support structure including a first sheet having a front surface, a back surface and a first anchoring member, and a second sheet having a front surface, a back surface and a second anchoring member. A core made of a first material is formed between the back surface of the first sheet and the back surface of the second sheet and anchored to the first anchoring member and the second anchoring member.

Implementations of the invention may also include one or more of the following features. The anchoring members may include perforations in the first sheet and the second sheet, respectively, each perforation having a portion adjacent to the front surface of the sheet that is wider than a portion of the perforation that is adjacent to the back surface of the sheet. The anchoring members may also include studs, expanded metal sheets, or perforated sheets in which the perforations have a portion adjacent to the front surface of the perforated sheet that is wider than a portion of the perforation that is adjacent to the back surface of the perforated sheet.

In general, in another aspect, the invention features a method of assembling a support structure. A first sheet having a back surface and a first anchoring member attached to the back surface, and a second sheet having a back surface and a second anchoring member attached to the back surface, are provided. The back surfaces of the first and second sheets are oriented spaced apart from and facing each other. A core is formed between the spaced apart back surfaces of the first and second sheets.

In general, in another aspect, the invention features a horizontal base. A first sheet with perforations has a front surface and a back surface and a second sheet with perforations has a front surface and a back surface, each perforation in the first sheet and the second sheet having a portion adjacent to the front surface of the sheet that is wider than a portion of the perforation that is adjacent to the back surface of the sheet. A core made of a first material is formed between the back surface of the first sheet and the back surface of the second sheet and within the perforations to anchor the first sheet and the second sheet to the core. A mounting boss is disposed on the front surface of the first sheet and integrally formed with the core, the mounting boss being attached to the core through a perforation in the first sheet.

Implementations of the invention may also include the following feature. The horizontal base may further include a plurality of legs disposed on the front surface of the second sheet and integrally formed with the core, the legs being attached to the core through perforations in the second sheet.

In general, in another aspect, the invention features an end-of-arm tool. A first sheet with perforations has a front surface and a back surface and a second sheet with perforations has a front surface and a back surface, each perforation in the first sheet and the second sheet having a portion adjacent to the front surface of the sheet that is wider than a portion of the perforation that is adjacent to the back surface of the sheet. A core made of a first material is formed between the back surface of the first sheet and the back surface of the second sheet and within the perforations to anchor the first sheet and the second sheet to the core. A plurality of molded features are disposed on the front surface of the first sheet and the front surface of the second sheet and integrally formed with the core, the molded features being attached to the core through perforations in the first sheet and the second sheet.

Implementations of the invention may also include one or more of the following features. The molded features may be bosses or pivot lugs.

An advantage of the present invention is the ease and simplicity of forming the support structure, e.g., a core for an abrasive tool.

Another advantage of the present invention is the strength, durability, and dimensional stability of the support structure, which allows for selection from a wide range of materials.

Another advantage of the present invention is the high strength-to-weight ratios of the composite material used to form the support structure compared to any of the construction materials singularly.

A further advantage is the versatility of the support structure, which may have varying shapes and uses.

Other features and advantages of the invention will become apparent from the following detailed description, and from the claims.

DESCRIPTION OF THE PREFERRED EMBODIMENTS

Figure 1:
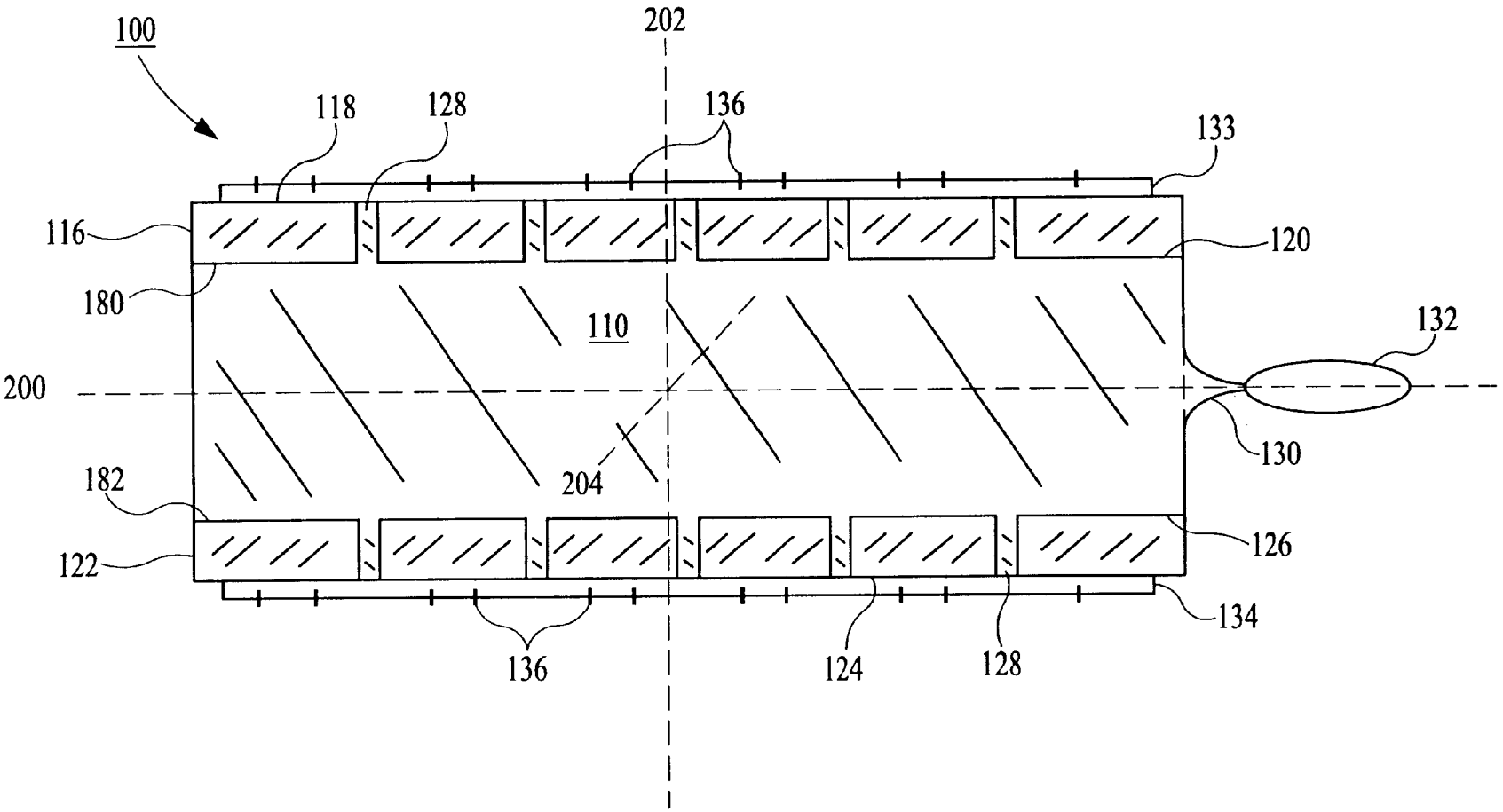
FIG. 1 is a diagrammatic, sectional side view of a file constructed according to the present invention.
Figure 2:
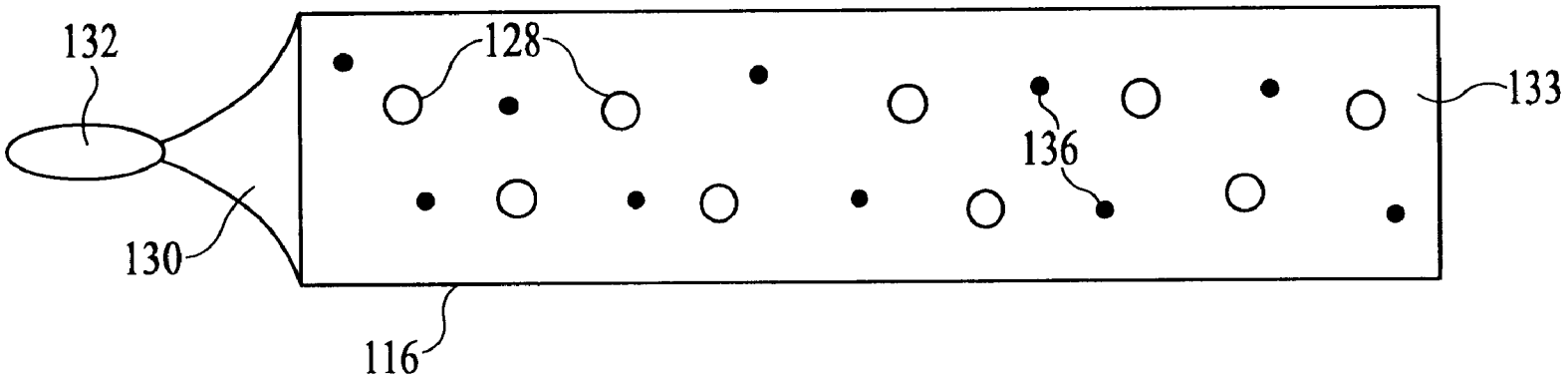
FIG. 2 is a diagrammatic plan view of the upper surface of the file of FIG. 1.
Figure 3:
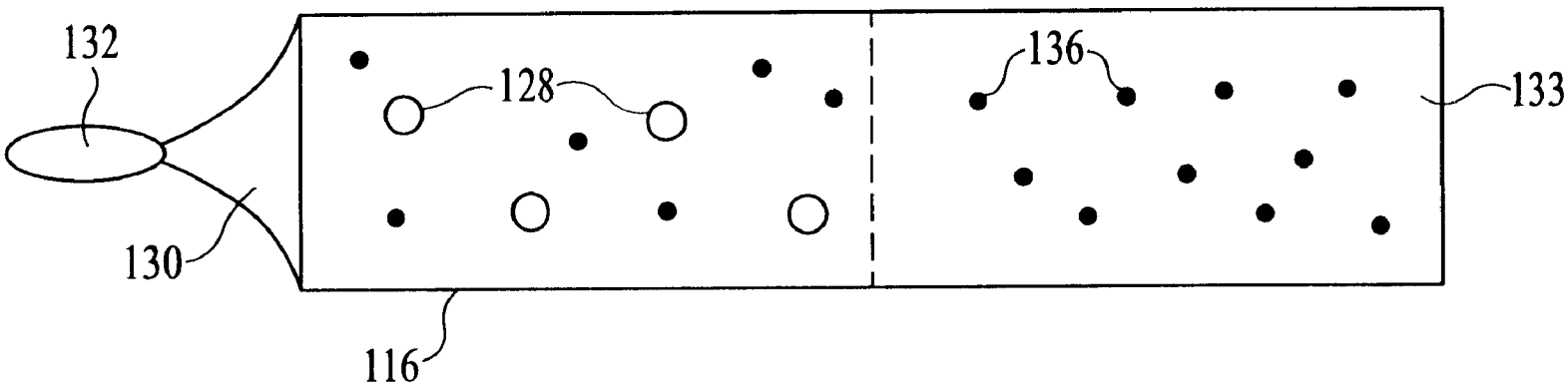
FIG. 3 is a diagrammatic plan view of an alternate embodiment of the upper surface of the file of FIGS. 1 and 2 which is perforated only over a portion of its abrasive surface.
Figure 7:
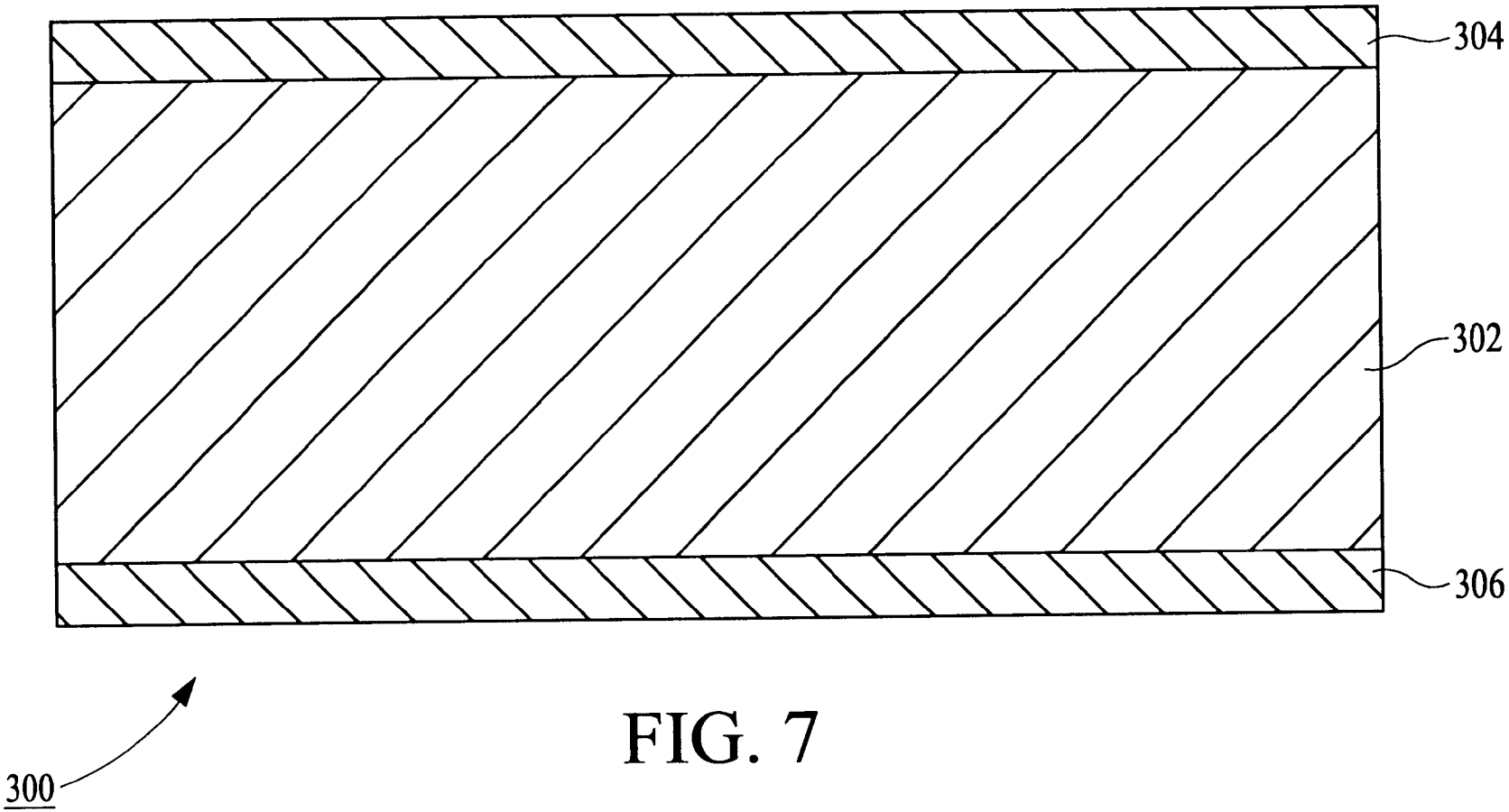
FIG. 7 is a diagrammatic, sectional side view of a support structure constructed according to the present invention.

As shown in FIG. 7, a support structure 300 according to the present invention includes a core 302 formed between two sheets 304, 306. The formation and features of support structure 300 are described below with respect to the exemplary use of the support structure in an abrasive tool such as a hand-held file 100, as shown in FIGS. 1, 2 and 3. Such an abrasive tool may also be, e.g., a whetstone, a grinding wheel or a slip stone.

File 100 includes a core 110 having a first surface 180 and a second surface 182, and sheets 116, 122. Sheets 116, 122 have front surfaces 118, 124 and back surfaces 120, 126, respectively. File 100 may also include a lateral projection 130 integrally formed with core 110, to which a handle 132 or other support structure may be attached.

Sheets 116, 122 are preferably made from a hard metal such as steel, but may be made of any metal, e.g., stainless steel or aluminum. Further, sheets 116, 122 may be made of a magnetic material. Depending on the type of metal used to make the sheets, the sheets or the finished abrasive tool may be magnetically clamped during processing, i.e. injection molding or grinding, or in use. Sheets 116, 122 may contain perforations, e.g., round holes 128, extending through sheets 116, 122. The perforations may have any shape, e.g., square, circular, or diamond shaped holes. Further, sheets 116, 122 may have any shape, e.g., flat, round, conical or curved.

Figure 4C:
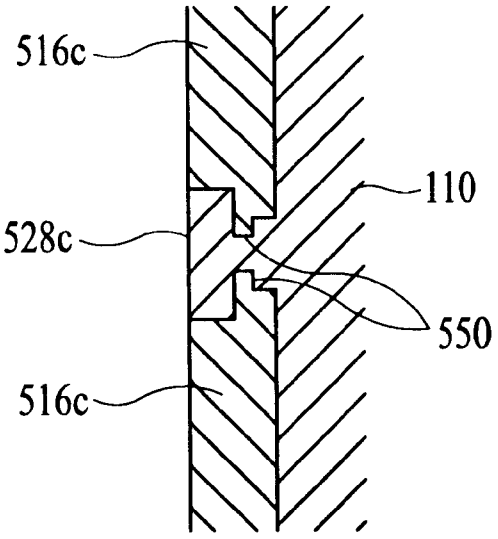
FIGS. 4A–4C show diagrammatic, fragmentary cross-sectional views of anchoring members in the sheets used to construct a file according to the present invention.
Figure 4B:
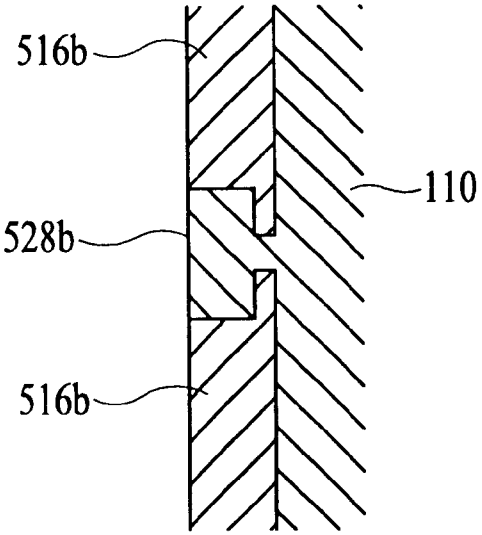
Figure 4A:
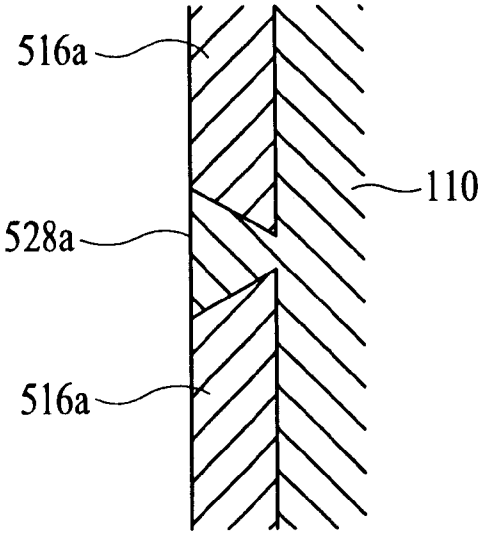

As seen in FIGS. 4A–4C, the perforations are preferably bevelled or counterbored holes which form anchoring members to anchor sheets 516*a*–516*c* to the core. The bevelled counterbored holes may have a variety of different configurations. FIG. 4A shows a beveled hole 528*a* in sheet 516*a*. FIGS. 4B and 4C both show stepped counterbored holes 528*b* and 528*c*, with hole 528*c* having projections 550. Other bevelled or counterbored configurations perform the same function. The essential feature of such a bevelled or counterbored hole is that some portion of the perforation that is closer to the front surface of the sheet is broader or wider, in a plane parallel to the sheet, than at least some portion of the perforation that is closer to the back surface of the sheet.

A pattern of perforations is known as an interrupted cut pattern. As illustrated in FIG. 2, a preferred embodiment of the present invention has an interrupted cut pattern with sheets for which 40% of the surface area has been cut out for the perforations. In an alternate embodiment, only a portion of each of sheets 116, 122 contains perforations, while the remainder contains no perforations (FIG. 3). Any arbitrary portion of sheets 116, 122 may contain perforations to form an interrupted cut pattern, such that the majority of the area of each sheets forms a continuous surface.

Figure 10:
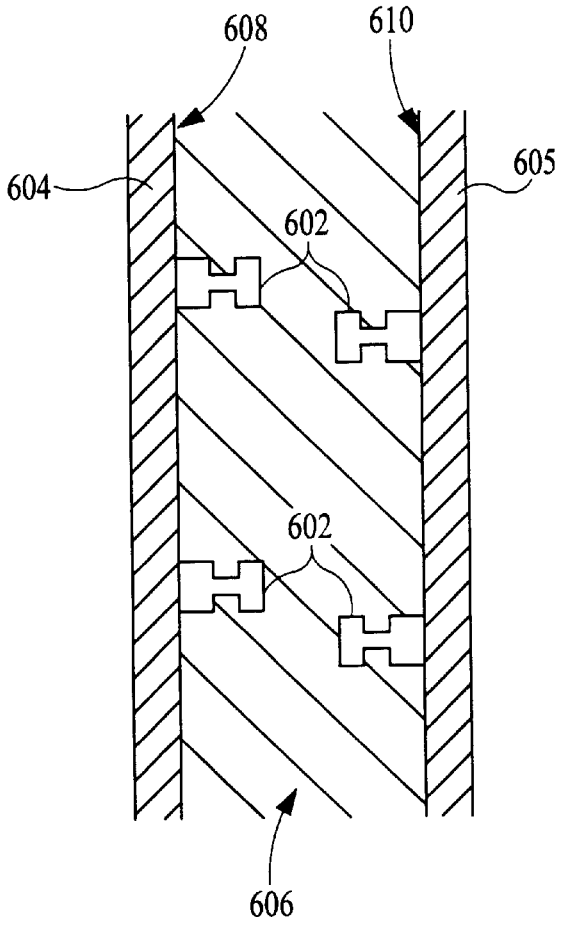
FIG. 10 is a diagrammatic, fragmentary cross-sectional view of stud anchoring members used to construct a file according to the present invention.
Figure 11:
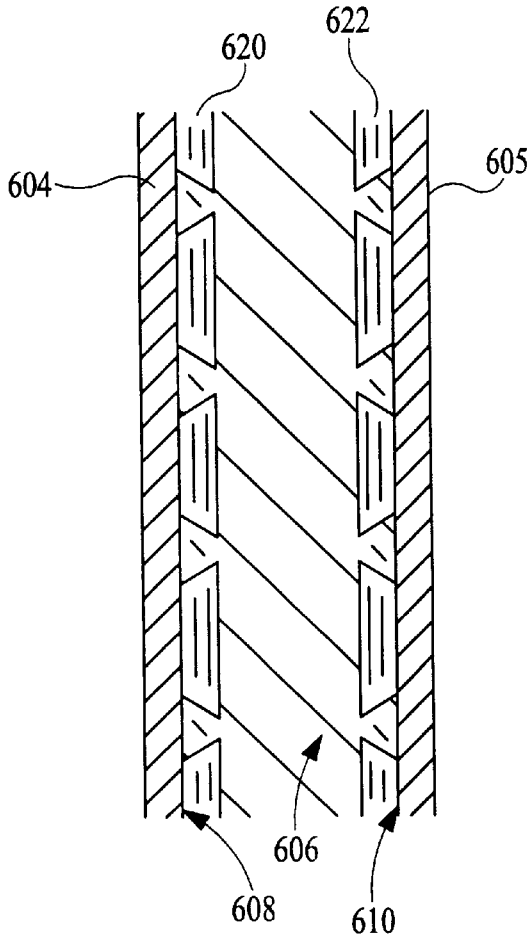
FIG. 11 is a diagrammatic, fragmentary cross-sectional view of a perforated sheet brazed to an unperforated sheet used as an anchoring member in constructing a file according to the present invention.
Figure 12:
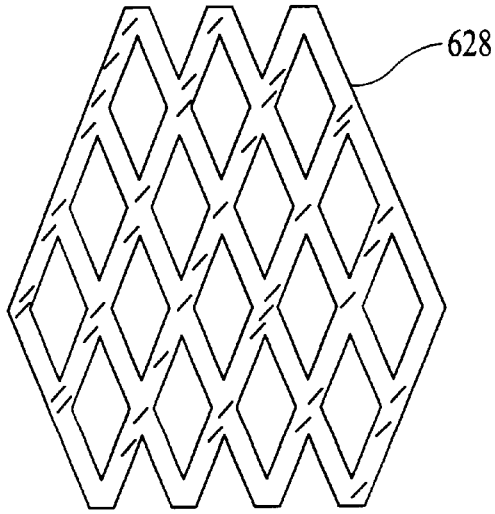
FIG. 12 is a diagrammatic plan view of an expanded metal sheet which may be used as an anchoring member in constructing a file according to the present invention.

The sheets may also be anchored to the core with other types of anchoring members. As shown in FIG. 10, such anchoring members may have the form of metal studs 602 welded to the back surfaces 608, 610 of (unperforated) sheets 604, 605 prior to forming core 606 between the sheets. As shown in FIG. 11, the anchor member may be perforated metal sheets 620, 622 attached by brazing to the back surfaces 608, 610 of (unperforated) sheets 604, 605 prior to forming core 606 between the sheets. In this case, the perforations are preferably bevelled or counterbored holes, as described above with respect to FIGS. 4A–4C. Alternatively, as shown in FIG. 12, an expanded metal sheet 628, formed by making slits in and then stretching or expanding a metal sheet, can be attached by brazing to the back surfaces 608, 610 of (unperforated) sheets 604, 605 prior to forming core 606 between the sheets. For the alternative anchoring members shown in FIGS. 10–12, the essential feature is that the core can form around projections, i.e., studs 602, or within a crevice, i.e., the perforations in sheets 620, 622 or the open areas in expanded metal sheet 628, to anchor the core to the sheets.

The back surfaces 120, 126 of sheets 116, 122, respectively, are bonded to the first and second surfaces 180, 182 of core 110, which is formed between sheets 116, 122. Core 110 may be formed by injection molding, casting or laminating. Core 110 is preferably made from a plastic material, preferably a glass filled polycarbonate composite (e.g., 40% glass filled polycarbonate). Such a composite material has an inherently higher strength to weight ratio than any of the individual materials used to form the composite. Alternatively, the core may be made of a resin, epoxy or cementitious material. Further, core 110 may be any shape, e.g., flat, round, conical or curved, depending on the shape of sheets 116, 122.

Figure 5:
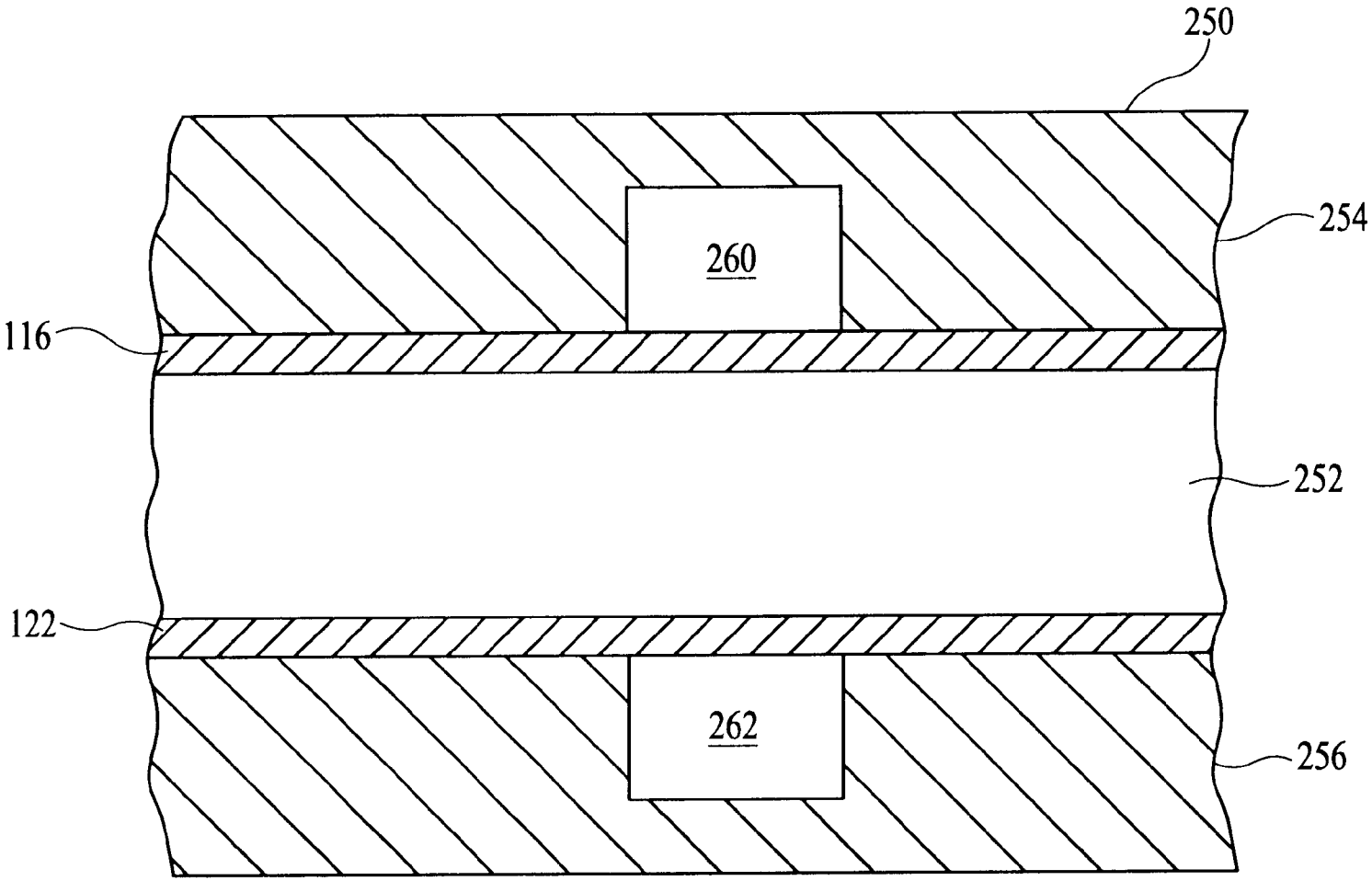
FIG. 5 is a diagrammatic, sectional side view of a mold for constructing a file according to the present invention.

FIG. 5 shows a core 110 formed between perforated sheets 116, 122 using a mold 250. The mold may have steel frame portions 254, 256 containing magnets 260, 262. The sheets may be held within mold cavity 252 using, e.g., magnets 260, 262. Back surfaces 120, 126 of sheets 116, 122 are held spaced apart from each other, creating a space within mold cavity 252 in which the core is formed.

Sheets 116, 122 are bonded to core 110 by injection molding, casting or laminating. For example, to form file 100, a liquid or semi-solid material, e.g., heated plastic material, that forms core 110 may be forced between sheets 116, 122 under injection pressure. During the injection molding, the liquid or semi-solid material flows into the space to create the core and flows into the perforation holes 128 in sheets 116, 122. For the alternative anchoring members shown in FIGS. 10–12, the material may flow around the studs 602 or into the perforations in sheets 620, 622 or the open areas of expanded metal sheet 628. The liquid or semi-solid material hardens, by cooling or curing, to form the core. Core 110 is then anchored to sheets 116, 122, since the core material that has flowed around studs 602 or into perforation holes 128 or open areas of expanded mental sheet 628 resists separation of core 110 from sheets 116, 122, particularly if the perforation holes are counterbored or bevelled as described above.

Abrasive surfaces 133, 134 are formed on front surfaces 118, 124 of sheets 116, 122. Abrasive surfaces 133, 134 may be, e.g., grinding, honing, lapping or deburring surfaces, and may be, e.g., flat or curved, depending on the shape and use of the abrasive tool.

Abrasive surfaces 133, 134 are formed by bonding abrasive grains 136 to front surfaces 118, 124 of sheets 116, 122 in areas other than holes 128. Abrasive grains 136 do not bond to the core material, e.g., plastic, within holes 128. Since abrasive surfaces 133, 134 extend above the surface of sheets 116, 122, front surfaces 118, 124 of sheets 116, 122 have an interrupted cut pattern which provides recesses into which filed or deburred particles or chips may fall while the abrasive tool is being used on a work piece. An abrasive tool with an interrupted cut pattern is able to cut or file the work piece faster by virtue of providing chip clearance.

Abrasive grains 136 may be particles of, e.g., superabrasive monocrystalline diamond, polycrystalline diamond, or cubic boron nitride. Abrasive grains 136 may be bonded to front surfaces 118, 124 of sheets 116, 122 by electroless or electrode plated nickel or other plating material or bonding, or by brazing if the core is made of suitably high temperature resistant material.

Abrasive surfaces 133, 134 may be given the same degree of abrasiveness by subjecting front surfaces 118, 124 of sheets 116, 122 to identical processes. Alternately, the abrasive surfaces 133, 134 may be given differing degrees of abrasiveness, by bonding different types, sizes, or concentrations of abrasive grains 136 onto the two front surfaces 118, 124 of sheets 116, 122.

Abrasive grains 136 may be bonded to front surfaces 118, 124 of sheets 116, 122 by electroplating or anodizing aluminum precharged with diamond. See, e.g., U.S. Pat. No. 3,287,862, which is incorporated herein by reference. Electroplating is a common bonding technique for most metals that applies Faraday's law. For example, the sheets 116, 122 bonded to core 110 are attached to a negative voltage source and placed in a suspension containing positively charged nickel ions and diamond particles. As diamond particles fall onto front surfaces 118, 124 of sheets 116, 122, nickel builds up around the particles to hold them in place. Thus, the diamond particles bonded to front surfaces 118, 124 of sheets 116, 122 are partially buried in a layer of nickel.

Alternately, abrasive grains 136 such as diamond particles may be sprinkled onto front surfaces 118, 124 of sheets 116, 122, and then a polished steel roller which is harder than sheets 116, 122 may be used to push abrasive grains into front surfaces 118, 124 of sheets 116, 122. For example, in this case sheets 116, 122 may be aluminum.

Alternately, abrasive grains 136 may be bonded to front surfaces 118, 124 of sheets 116, 122 by brazing. For example, to bond diamond particles by brazing, a soft, tacky brazing material or shim, e.g., in the form of a paste, spray or thin solid layer, is applied to the front surfaces 118, 124 of sheets 116, 122. The shim is made, e.g., from an alloy of a metal and a flux material that has a melting point lower than the melting point of sheets 116, 122 or core 110.

Diamond particles are poured onto the shim, which holds many of the diamond particles in place due to its tackiness. Excess diamond particles that do not adhere to the shim may be poured off. Sheets 116, 122 are then heated until the shim melts. Upon solidification, the diamond particles are embedded in the shim, which is also securely bonded to the front surfaces 118, 124 of sheets 116, 122. In addition, diamond particles can be kept out of the holes 128 in sheets 116, 122 by failing to apply the shim material inside holes 128.

Figure 6:
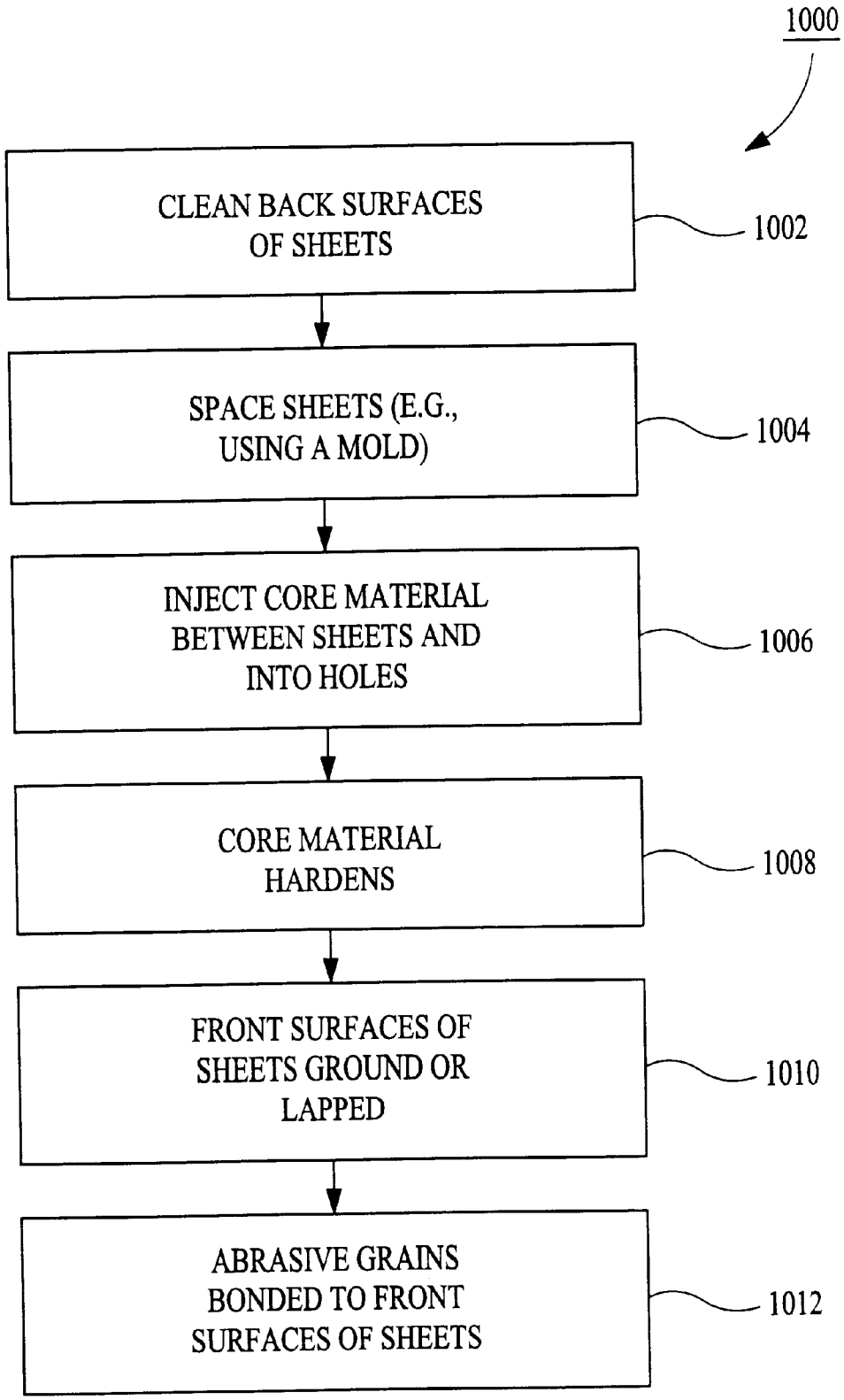
FIG. 6 is a flow chart showing a method of assembling an abrasive tool according to the present invention.

FIG. 6 shows a method 1000 for constructing file 100. First, back surfaces 120, 126 of perforated sheets 116, 122 are cleaned (step 1002).

In step 1004, sheets 116, 122 are spaced apart from each other. For example, sheets 116, 122 may be retained in a spaced orientation within a mold, with back surfaces 120, 126 facing each other.

Core 110 is formed between sheets 116, 122 by injection molding, casting or laminating. With injection molding, liquid or semi-solid core material is injected into the space between sheets 116, 122 and flows into perforation holes 128 (step 1006). The core material then hardens or cures to form the core 110 with sheets 116, 122 bonded thereto (step 1008).

The front surfaces 118, 124 of sheets 116, 122 may be ground or lapped for precision flatness (step 1010). The grinding step also removes any core material that may have flowed though perforation holes 128 and become deposited on one of the front surfaces 118, 124 of the sheets 116, 122.

Abrasive grains 136 are then bonded to front surfaces 118, 124 of sheets 116, 122 to form abrasive surfaces 132, 134 (step 1012).

In a preferred embodiment, sheets 116, 122 are bonded to core 110 (steps 1006 and 1008) prior to forming abrasive surfaces 132, 134 (step 1012). In particular, the use of a non-conductive plastic core material for core 110 minimizes the quantity of grains 136 that are used; i.e., nickel will not be deposited on non-conductive plastic core 110 during the electroplating process, so that no diamond grains 136 will accumulate on core 110. Alternately, abrasive surfaces may be formed on sheets 116, 122 (step 1012) prior to bonding sheets 116, 122 to core 110 (steps 1006 and 1008).

This method of constructing file 100 may be used to construct any abrasive tool structure, including but not limited to the manufacture of a two-sided whetstone. The method may also be used to form support structure 300 (FIG. 7) for a variety of other uses, as explained below. A core formed between two parallel perforated sheets preferably has symmetrical cross sections in planes in three dimensions, i.e., along the length, width and height axes of the core (200, 202 and 204 in FIG. 1). This structure also results in maximum spacing of the sheets from the structurally neutral bending axis. As a result, the distribution and relief of stresses within each plane are symmetrical during subsequent operations with the support structure, e.g., using file 100 for grinding, the net effect being overall dimensional stability of the composite structure. Moreover, a support structure formed by injection molding, casting or laminating the core between two sheets will force shrinking or contracting anisotropically, which helps to control warp or distortion and creates less residual stress on the core.

Figure 8:
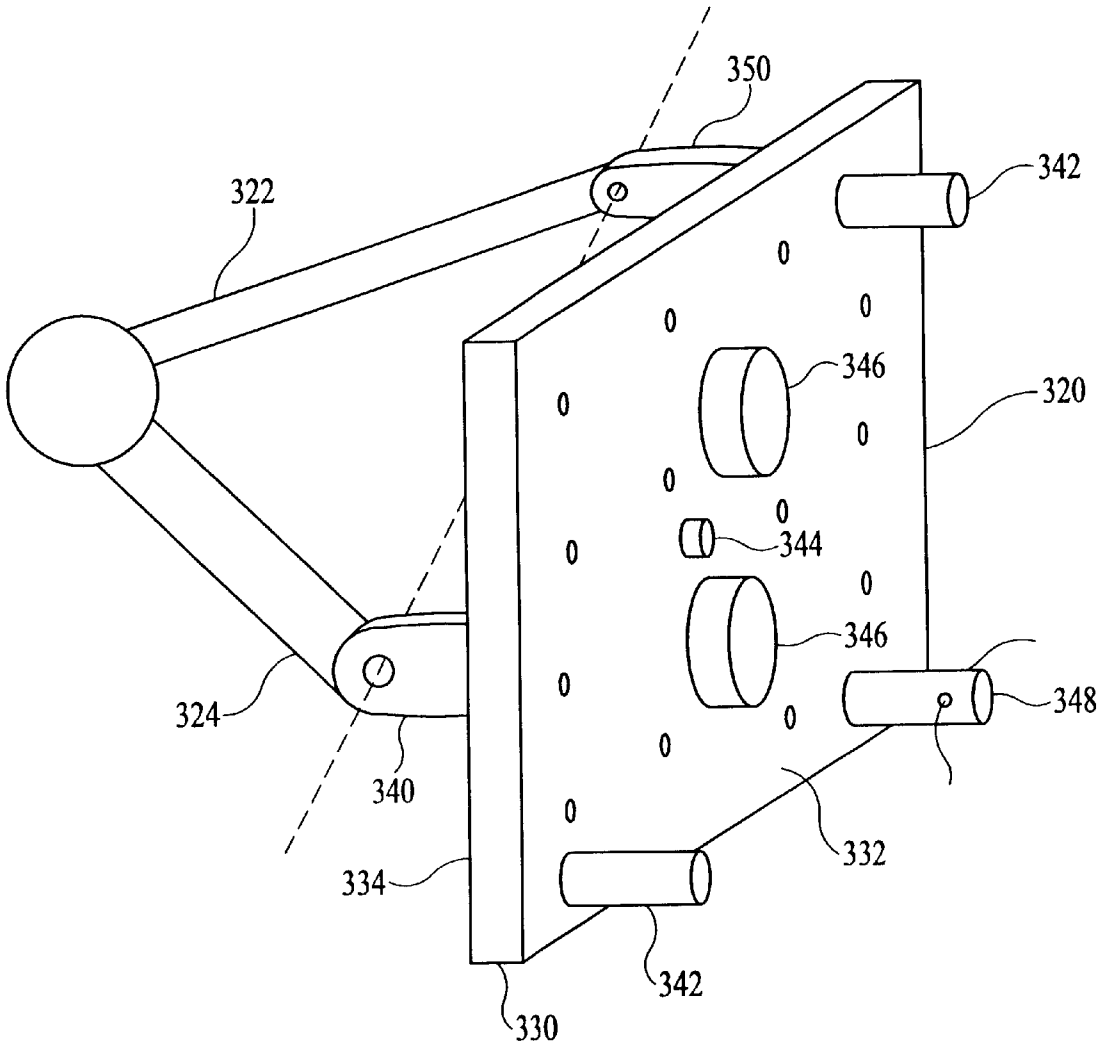
FIG. 8 is a diagrammatic perspective view of an end-of-arm tool constructed according to the present invention.

As shown in FIG. 8, the support structure of the present invention may be used in an end-of-arm tool 320 for a robotic arm 322. Such robotic arms are used for fast and accurate pick up and placement of components, e.g., in the insert injection molding and assembly industry.

Robotic arm 322 typically has three degrees of freedom of movement. End-of-arm tool 320, which may be fixed to one end 324 of robotic arm 322, can provide additional degrees of freedom, such as "wrist" rotation in one or two degrees of freedom, as well as providing additional reach from end-of-arm tool 320.

To function as an end-of-arm tool, the support structure includes a core 330, e.g., made of plastic, and two parallel, metal perforated plates 332, 334, with additional features attached to the outer surfaces of the plates. The perforations are bevelled or counterbored holes as described above with respect to FIGS. 4A–4C. The additional features attached to the plates may include wrist rotation and pivot lugs 340, piloting pins 342 for precision docking or end of travel guidance for the end-of-arm-tool upon contacting a working piece or tool, mounting sensor 344 for checking docking conditions, telescoping mounts 346, bosses 348 for mounting wires, and other attachment features for arm mounting such as pivoting actuator lug 350.

The additional features attached to the plates may be created as molded plastic features protruding from either or both outer surfaces of plates 332, 334 and formed integrally with core 330, the additional features being attached to the core through the perforations in the plates. This construction results in continuity of the core between the metal plates and the additional features attached to the plates for enhanced stability and rigidity. This construction also has the advantages of dampening of the composite material, reliability resulting from part consolidation to avoid loosening or shifting of the additional features attached to the plates, and simplicity of variations of design using standard molding techniques. The additional features attached to the plates may also be fitted with hard faces, bushings or other terminations, e.g., by insert molding or by post molding assembly techniques.

Figure 9:
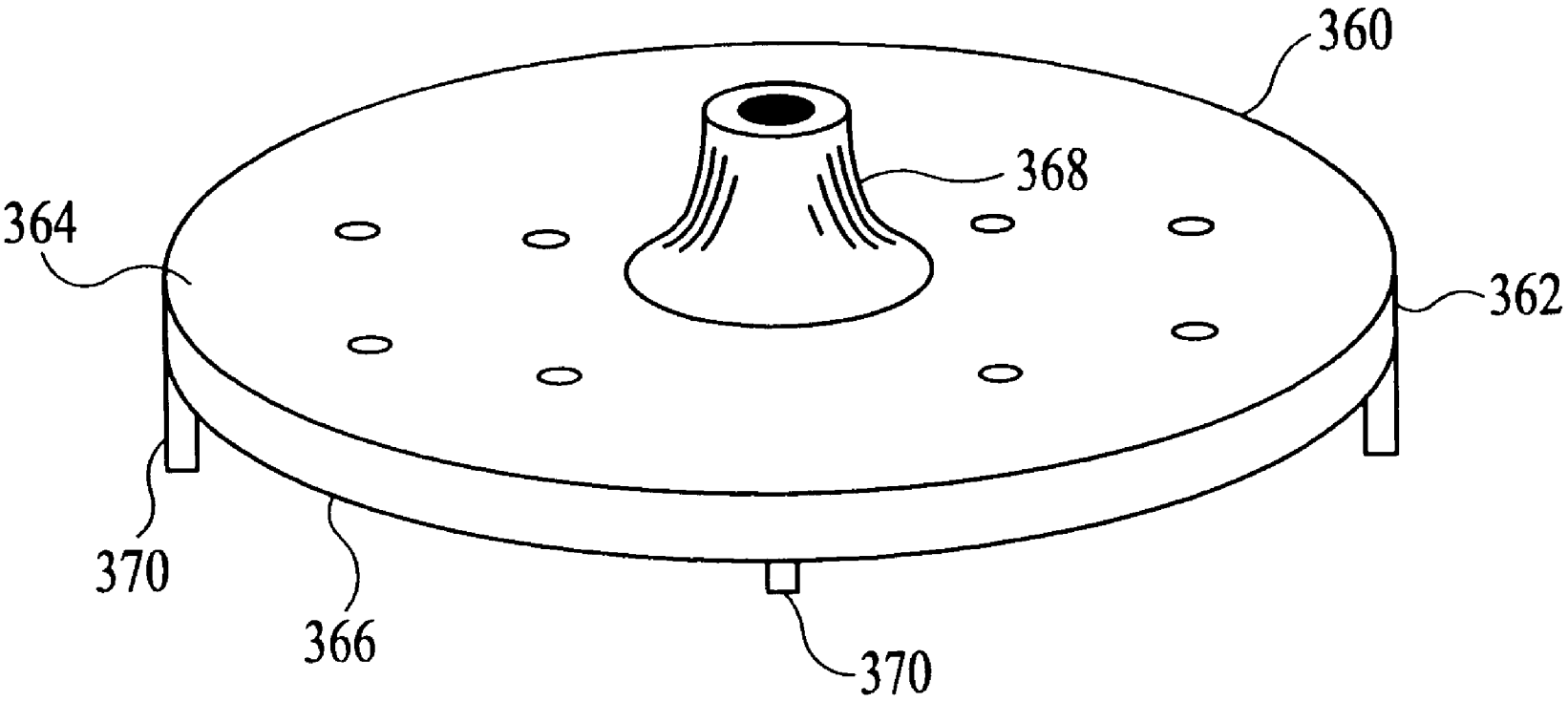
FIG. 9 is a diagrammatic perspective view of a horizontal base constructed according to the present invention.

As shown in FIG. 9, the support structure of the present invention may be used in a structural horizonal base 360 for vertical structures such as chairs, lamps and computer stands. Such vertical structures typically require cantilever mounting of a vertical beam, rod or strut from a flat or domed base of sufficient horizontal dimension to assure stability, i.e., so that the vertical structure will not tip over.

Horizontal base 360 includes a core 362, e.g., plastic, formed between two perforated metal inserts 364, 366. The perforations are bevelled or counterbored holes as described above with respect to FIGS. 4A–4C. Upper insert 364 may be, e.g., flat or domed, and may include features such as a mounting boss or cantilever socket 368 and ornamentation. Lower insert 366 may include features such as stub legs or pads 370.

The features, such as mounting boss 368 and legs 370, attached to inserts 364, 366 may be created as molded plastic features protruding from the outer surfaces of the plates and formed integrally with core 362, the molded features being attached to the core through the perforations in the inserts. This construction results in continuity of the core between the inserts and the features attached to the inserts for enhanced stability, rigidity and strength-to-weight ratio. This construction also has the advantage of reliability resulting from part consolidation to avoid loosening or shifting of the features attached to the inserts.

Other embodiments are within the scope of the following claims. In an alternative embodiment, the abrasive tool includes more than two sheets, and thus more than two abrasive surfaces. For example, the use of sheets made of a magnetic material allows for magnetic or vacuum chucking for multiple sharpening surfaces. Such magnetic sheets allow multiple units to be used simultaneously, in the form of a mosaic, such as for a whetstone.

What is claimed is:

1. A support structure, comprising:

a first sheet with perforations having a front surface and a back surface and a second sheet with perforation having a front surface and a back surface, each perforation in the first sheet and the second sheet having a portion adjacent to the front surface of the sheet that is wider than a portion of the perforation that is adjacent to the back surface of the sheet; and a core made of a first material, the core being formed between the back surface of the first sheet and the back surface of the second sheet and within the perforations to anchor the first sheet and the second sheet to the core.

2. The support structure according to claim 1 wherein the core is formed by injection molding.

3. The support structure according to claim 1 wherein the core is formed by casting.

4. The support structure according to claim 1 wherein the core is formed by laminating.

5. The support structure according to claim 1 wherein the first material comprises a plastic material.

6. The support structure according to claim 5 wherein the plastic material is a glass filled polycarbonate composite.

7. The support structure according to claim 1 wherein the first material comprises resin.

8. The support structure according to claim 1 wherein the first material comprises epoxy.

9. The support structure according to claim 1 wherein the first material comprises a cementitious material.

10. The support structure according to claim 1 wherein the perforations are bevelled.

11. The support structure according to claim 1 wherein the perforations are counterbored.

12. The support structure according to claim 1 wherein the first sheet and the second sheet have perforations in a portion less than the entirety of the sheets.

13. The support structure according to claim 1 further comprising a molded feature disposed on the front surface of the first sheet and integrally formed with the core, the molded feature being attached to the core through a perforation in the first sheet.

14. A method of assembling a support structure, comprising:

providing a first sheet having a front surface and a back surface and perforations therein, each perforation having a portion adjacent to the front surface of the sheet that is wider than a portion of the perforation that is adjacent to the back surface of the sheet;

providing a second sheet having a front surface and a back surface and perforations therein, each perforation having a portion adjacent to the front surface of the sheet that is wider than a portion of the perforation that is adjacent to the back surface of the sheet;

orienting the back surfaces of the first and second sheets spaced apart from and facing each other; and forming a core between the spaced apart back surfaces of the first and second sheets and in the perforations in the first and second sheets.

15. The method of claim 14 wherein the core is formed by injecting a first material between the spaced apart back surfaces of the first and second sheets and the first material is hardened.

16. The method of claim 15 wherein the first material injected between the spaced apart back surfaces of the first and second sheets flows into the perforations in the first and second sheets.

17. The method of claim 14 wherein the core is formed by casting.

18. The method of claim 14 wherein the core is formed by laminating.

19. The method of claim 14 wherein the orienting step includes placing the first and second sheets into a mold.

20. The method of claim 14 further comprising grinding the front surfaces of the first and second sheets.

21. A horizontal base, comprising:

a first sheet with perforations having a front surface and a back surface and a second sheet with perforations having a front surface and a back surface, each perforation in the first sheet and the second sheet having a portion adjacent to the front surface of the sheet that is wider than a portion of the perforation that is adjacent to the back surface of the sheet;

a core made of a first material, the core being formed between the back surface of the first sheet and the back surface of the second sheet and within the perforations to anchor the first sheet and the second sheet to the core; and a mounting boss disposed on the front surface of the first sheet and integrally formed with the core, the mounting boss being attached to the core through a perforation in the first sheet.

22. The horizontal base according to claim 21 further comprising:

a plurality of legs disposed on the front surface of the second sheet and integrally formed with the core, the legs being attached to the core through perforations in the second sheet.

23. An end-of-arm tool, comprising:

a first sheet with perforations having a front surface and a back surface and a second sheet with perforations having a front surface and a back surface, each perforation in the first sheet and the second sheet having a portion adjacent to the front surface of the sheet that is wider than a portion of the perforation that is adjacent to the back surface of the sheet;

a core made of a first material, the core being formed between the back surface of the first sheet and the back surface of the second sheet and within the perforations to anchor the first sheet and the second sheet to the core; and a plurality of molded features disposed on the front surface of the first sheet and the front surface of the second sheet and integrally formed with the core, the molded features being attached to the core through perforations in the first sheet and the second sheet.

24. The end-of-arm tool according to claim 23 wherein the molded features are bosses.

25. The end-of-arm tool according to claim 23 wherein the molded features are pivot lugs.

* * * * *